United States Patent [19]

Anderson

[11] Patent Number: 4,549,057

[45] Date of Patent: Oct. 22, 1985

[54] FLUX CONCENTRATOR ASSEMBLY FOR INDUCTOR

[75] Inventor: Keith Anderson, Clawson, Mich.

[73] Assignee: Tocco, Inc., Boaz, Ala.

[21] Appl. No.: 664,371

[22] Filed: Oct. 24, 1984

[51] Int. Cl.[4] ..... H05B 6/40

[52] U.S. Cl. ..... 219/10.79; 219/10.49 R; 219/10.57; 219/10.43; 29/606; 29/609; 336/234

[58] Field of Search ..... 219/10.79, 10.49 R, 219/10.43, 10.57, 9.5, 8.5; 29/602 R, 606, 607, 608, 609; 336/233, 234, 62

[56] References Cited

U.S. PATENT DOCUMENTS

| | | | |
|---|---|---|---|
| 2,513,376 | 7/1950 | Strickland, Jr. | 210/10.79 |
| 2,715,171 | 8/1955 | Williamson | 219/10.79 |
| 3,242,299 | 3/1966 | Laughlin et al. | 219/8.5 |
| 3,248,512 | 4/1966 | Sommer | 219/8.5 |
| 3,453,726 | 7/1969 | Roen | 29/609 X |
| 3,649,797 | 3/1972 | Vickers | 219/10.79 |
| 3,659,069 | 4/1972 | Balzer et al. | 219/10.79 |
| 3,737,613 | 6/1973 | Gillock | 219/10.79 |
| 3,800,115 | 3/1974 | Cachat | 219/10.43 |
| 3,842,234 | 10/1974 | Seyfried | 219/10.79 |
| 4,204,314 | 5/1980 | Workman | 29/609 X |
| 4,315,232 | 2/1982 | Spoldi et al. | 29/606 X |

*Primary Examiner*—Philip H. Leung

*Attorney, Agent, or Firm*—Body, Vickers & Daniels

[57] ABSTRACT

A single loop inductor for inductively heating elongated workpieces is provided with flux concentrator assemblies accurately located on the parallel conductors by lamination keepers retained in keyways in the conductor.

8 Claims, 8 Drawing Figures

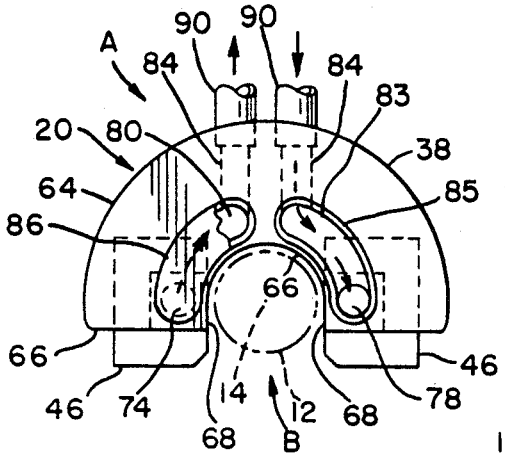
FIG. 3
FIG. 4
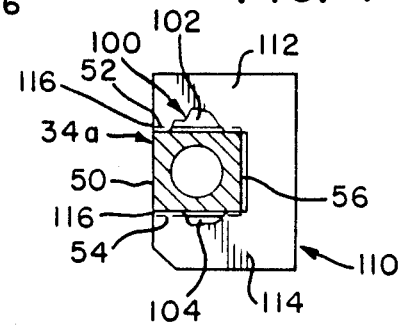
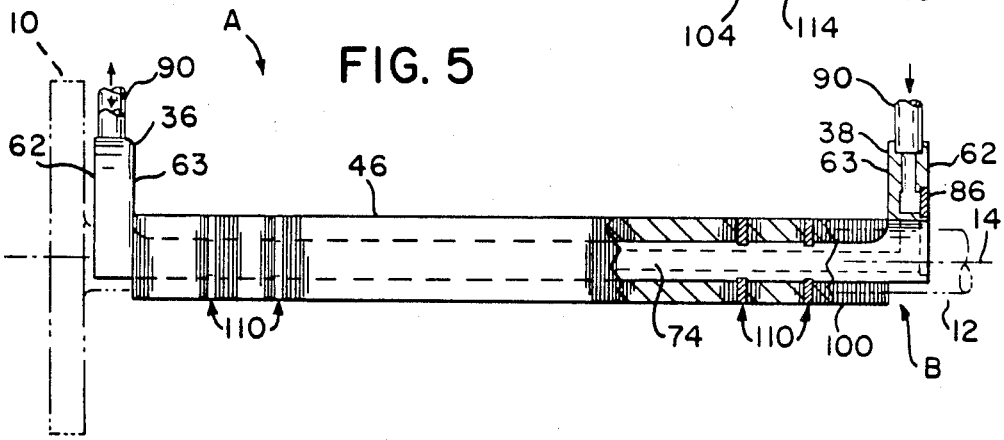
FIG. 5
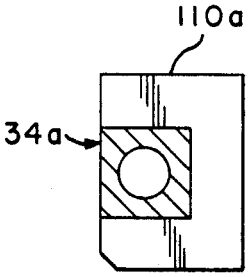
FIG. 6
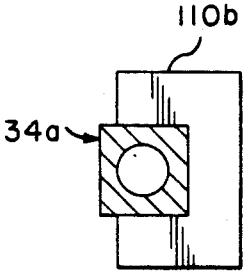
FIG. 7
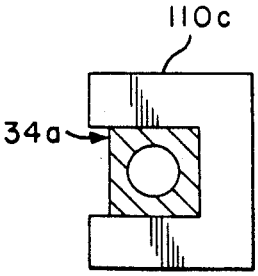
FIG. 8

FLUX CONCENTRATOR ASSEMBLY FOR INDUCTOR

The present invention relates to the art of induction heating and, in particular, to flux concentrator assemblies for single loop inductors.

The invention is particularly applicable to inductors for heating the complete length of an axle shaft and will be described with particular reference thereto; however, it should be appreciated that the invention has much broader applications and may be used for heating various other elongated workpieces of constant or varying cross sections.

Induction heating followed by controlled quenching has become an accepted technique for surface hardening extended lengths of axle shafts. Therein, the axle shaft is rotated within the flux field of a stationary, single loop inductor. The single loop inductor is effective to uniformly, inductively heat the total length of the axial shaft without requiring movement of the inductor. This single loop inductor, commonly referred to as a "single shot inductor", comprises a pair of parallel conductors which extend substantially the complete length of the axle shaft. The ends of the parallel conductors are interconnected by arcuate crossover conductors. One of the conductors, either a parallel conductor or a crossover, is divided to define an electrical discontinuity. Electrical leads are connected at the discontinuity and therefrom to a high frequency power supply. In operation, the flux field from the parallel conductors induces eddy current heating at the surface of the rotating shaft to raise the temperature thereof above the critical temperature for the shaft material. The depth and temperature are determined by conventional control of the electrical parameters. After the shaft surface has reached the predetermined heating temperature, quenching jets rapidly cool the shaft at a controlled rate to provide the desired material properties over the length of the axle shaft.

The control and versatility of the heating pattern for such single turn inductors may be enhanced by the use of flux concentrators mounted on the parallel conductors. These flux concentrators, generally a stack of U-shaped high permeability laminations, are effective to control the flux density along the axial length of the inductor to produce a uniform heating pattern and to concentrate the current density on the inner wall thereof. The shape of the concentrators can be modified to provide for cross-sectional profile variations in the workpiece without modification of the basic inductor design. The concentrators may also be varied in length and position to enable a single inductor design to heat workpieces of varying lengths and heating pattern locations.

In order to be fully effective in establishing the desired uniform heating pattern, it is necessary that flux concentrator be accurately located on the inductor. Present single loop inductors are generally fabricated from square copper tubing with the crossover conductors brazed to the parallel conductors at mitered joints. Even with advanced assembly techniques, it is difficult to accurately control the length of parallel conductors.

As a consequence of the conductor length variations, the number of laminations and locations thereof results in the heating pattern varying from inductor to inductor. Further, where workpiece profile changes occur, the proper laminations may not be accurately matched with the workpiece leading to local underheating or overheating with resulting non-uniform hardness over the length of the workpiece.

SUMMARY OF THE INVENTION

In accordance with the present invention, an improved flux concentrator assembly is provided which enables an accurate location of the laminations at predetermined axial locations on the conductors. More particularly, keyways are formed transversely in opposed surfaces of the parallel conductors at locations corresponding to the length over which the workpiece is to be heated. The keyways are referenced to the main heat treating apparatus such that the keyways are also referenced to the workpiece when the latter is at the heating position.

U-shaped keepers corresponding to the flux concentrator shapes have spaced legs dimensioned for close sliding engagement with the keyways. The laminations are banked and arrayed to establish the desired heating pattern with a length corresponding to the distance between adjacent keepers or a keeper and an opposed abutting surface. Accordingly, in assembly the length of the concentrator will be accurately axially prescribed and the individual concentrator laminates will be accurately positioned with respect to the workpiece profile. As a result, a uniform heating pattern will be achieved from inductor to inductor. Additional keyways may be formed on the inductors to facilitate interchange of flux concentrators thereby providing multi-workpiece capability for a single inductor.

Accordingly, a primary object of the present invention is to provide a flux concentrator for an inductor which establishes an accurately located flux concentrating field.

Another object of the present invention is to provide a mounting for an inductor flux concentrator which accurately locates a predetermined length of flux concentrator elements.

A further object of the present invention is to provide a flux concentrator having uniform performance characteristics from inductor to inductor.

Yet another object of the present invention is to provide a mounting and keeper assembly for readily locating arrays of flux concentrator laminations on an inductor to establish predetermined heating profiles.

BRIEF SUMMARY OF THE DRAWINGS

The above and other objects and advantages will become apparent from the following description taken in conjunction with the accompanying drawings, in which:

FIG. 3 is an end view taken along line 3—3 of FIG. 2 showing the flux concentrators positioned with respect to the shaft;

FIG. 4 is an enlarged cross sectional view taken along line 4—4 of FIG. 2 showing the mounting of the flux concentrator keeper on the parallel conductor;

FIG. 5 is a partially-sectioned side-elevational view of the inductor showing the flux concentrator keepers positioning the flux concentrators on the parallel conductor;

FIG. 6 is an enlarged cross sectional view taken along line 6—6 of FIG. 2 showing the mounting of one embodiment of the flux concentrator element on the parallel conductor;

FIG. 7 is a view similar to FIG. 6 showing another embodiment of the flux concentrator element; and, FIG. 8 is a view similar to FIG. 6 showing a further embodiment of the flux concentrator element.

DETAILED DESCRIPTION OF THE PREFERRED EMBODIMENT

Figure 2:
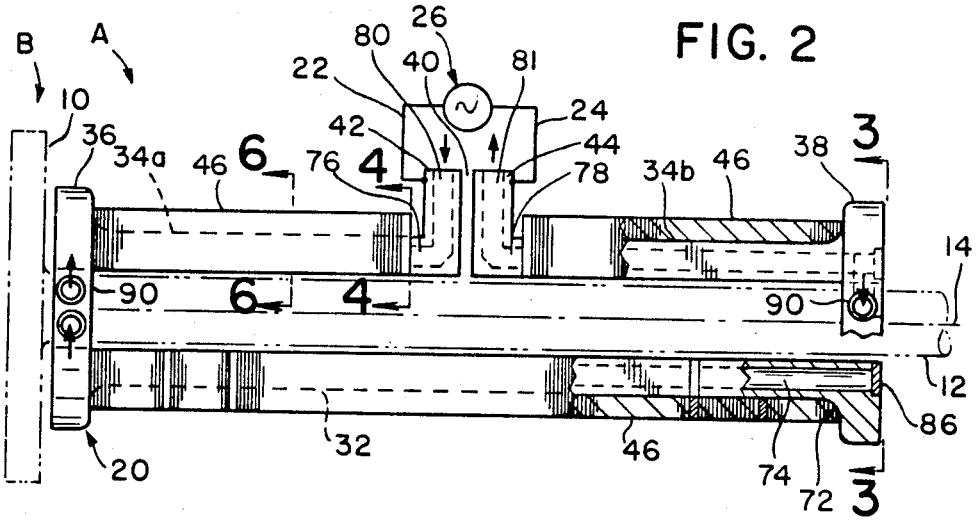
FIG. 2 is a plan view of the inductor of FIG. 1 showing the flux concentrators on the parallel conductors, schemmatically illustrating the electrical connection to a power supply, and showing in dashed lines an axle shaft to be inductively heated by the inductor.

Referring now to the drawings wherein the showings are for the purpose of illustrating a preferred embodiment of the invention only and not for the purpose of limiting same, FIG. 2 shows an induction heating apparatus A for inductively heating an elongated workpiece B, such as an axle shaft, having a circular flange 10 and a cylindrical shaft 12. The workpiece B is mounted for rotation about a horizontal axis 14 on a conventional induction heating unit, not shown. A predetermined length of the shaft 12 is heated to an elevated temperature by the induction heating apparatus A under conditions producing a uniform heating pattern to a predetermined depth. The heated shaft is then quenched by conventional quenching apparatus, not shown, under controlled conditions to produce a uniform hardness and hardened depth over the predetermined length of the shaft 12.

The heating apparatus A comprises a single-loop, or as commonly known a single-shot, inductor 20 connected by leads 22 and 24 to a conventional high frequency power supply 26. As hereinafter described, the inductor 20 includes internal coolant passages which are fluidly connected to a coolant supply, not shown.

Figure 1:
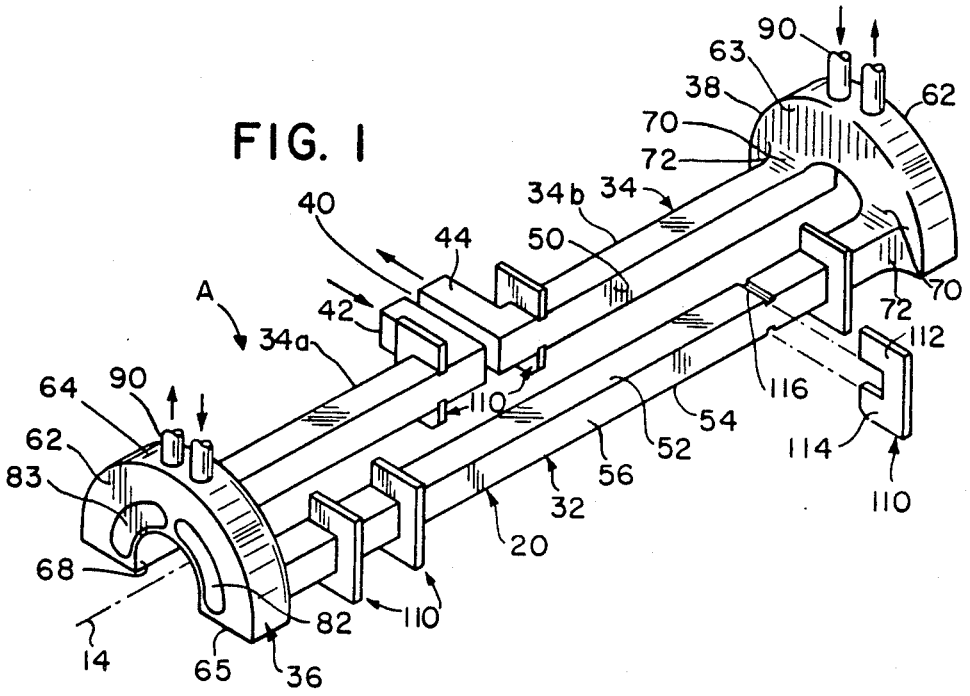
FIG. 1 is a perspective view of a single loop inductor showing the keepers for the flux concentrators in accordance with the preferred embodiment of the present invention.

Referring to FIG. 1, the inductor 20 generally comprises a pair of longitudinally extending parallel conductors 32 and 34 integrally connected at their outer ends to a pair of transversely extending arcuate crossover conductors 36 and 38. The parallel conductor 34 is longitudinally divided into two equal sections 34*a* and 34*b* at an electrical discontinuity or gap 40. The inner ends of the sections 34*a* and 34*b* terminate with radially outwardly projecting axially spaced power leads 42 and 44. The power leads 42 and 44 are respectively electrically connected in a conventional manner to the leads 22 and 24, respectively, of the power supply 26. Flux concentrator assemblies 46 are carried on the parallel conductors 32 and 34 of the inductor 20 as hereinafter described in greater detail. In assembly, the inductor 20 is fixedly mounted coaxially with the workpiece B about the axis 14 by a conventional holding fixture, not shown.

In accordance with the present invention, the inductor 20 hereinabove generally described, is fully machined from a single block of copper. With the exception of variations hereinafter noted, the inductor 20 is formed without mechanical or fabricated joints by conventional milling, drilling and turning operations. The inductor is particularly adapted for complete machining by computer assisted machinery centers.

The conductors 32 and 34, as shown in FIGS. 2 through 4, have square transverse cross sections and extend parallel to the axis 14. The conductors 32 and 34 are equally spaced with respect to the axis 14 and disposed in a common horizontal plane. The longitudinal length of the conductors as measured from the inner faces of the crossover connectors 36 and 38 is equal to the predetermined length over which the shaft 12 is to be uniformly hardened. Each of the conductors 34 and 36 has a vertical inner surface 50 which is radially spaced from the axis 14 to establish the requisite air gap with the outer surface of the shaft 12 thereby providing the required magnetic coupling during the inductive heating cycle. The conductors 34 and 36 have horizontal top and bottom surfaces 52 and 54, respectively, which are symmetrically disposed above and below the axis 14. Together with a vertical rear surface 56, the surfaces 50, 52 and 54 define a square transverse cross section. However, it will be apparent that rectangular or curvilear cross sections are also readily accomodated by the present invention.

The crossover conductors 36 and 38 have outer faces 62 lying in planes transverse to the axis 14 and coaxially spaced from the inner surface 63. The width between the faces 63 and 62 is substantially the same or greater than the width of the parallel conductors 32 and 34 as measured between the surfaces 50 and 56. The crossover conductors 36, 38 have an outer circular cylindrical surface 64, coaxial with the axis 14, having a diameter substantially greater than the width between the rear surfaces 56 of the parallel conductors 32 and 34. The crossover conductors have a horizontal lower surface 64 lying in a plane coextensive with the lower surface 54 of the parallel conductors 32 and 34. The crossover conductors have an inner hemi-cylindrical surface 66 coaxial with the axis 14 having a diameter substantially the same as the width between the inner surfaces 50 of the conductors 32 and 34. The surface 66 downwardly terminates with vertically extending surfaces 68 coextensive with the lower half of the inner surfaces 50 of the parallel conductors 32 and 34. Horizontal fillets 70 of a substantial radius are provided at the transition between the top surfaces 52 of the parallel conductors 32 and 34 and the inner faces 60 of the crossover conductors 36 and 38. Vertical fillets 72 of substantial radius are provided at the transition between the outer surfaces 56 of the parallel conductors 32 and 34 and the inner faces 60 of the crossover conductors 36 and 38. The fillets 70 and 72 reduce the stress concentration at the sectional transitions during operation of the inductor.

The inductor 20 is provided with a plurality of coolant passages which extend throughout the effective electrical length of the single loop. A single longitudinal passage 74 is drilled axially through parallel conductor 32 and the adjoining sections of crossover conductors 36 and 38. A pair of passages 76 and 78 are drilled axially through the crossover conductor 36 and the parallel conductor section 34*a*, and the crossover conductor 38 and the parallel conductor section 34*b*, respectively. The tips of the drilled passages 76 and 78 terminate just short of the inner surfaces of the leads 42 and 44 defining the gap 40. A pair of radial passages 80 and 81 are drilled centrally through the leads 42 and 44, respectively, and intersect with and fluidly communicate with the associated drilled passages 76 and 78. The diameter of the aforementioned drilled passages, together with the exterior dimensions of the parallel conductors, establishes a current flow path having sufficient capacity to handle the power load applied to the inductor during the inductive heating cycle. The circular drilled hole provides for greater cross section and power capacity than square tubing of comparable dimensions.

Referring to FIG. 3, a pair of arcuate milled slots 82 and 83 are formed in the end faces 62 of the crossover conductors 36 and 38. Each slot, 82 and 83 spans a sector of approximately 80° and has a lower end registering with the end of the drilled passages 74, 76 and 78 and an upper end which is spaced from the end of the adjacent slot. A pair of counterbored passages 84 are formed vertically in the crossover conductors 36 and 38 and fluidly communicate with the upper ends of each slot. A recessed rim 85 is formed adjacent the sidewall of the slots. An arcuate cover plate 86, corresponding in dimension to the rim, is received therein and brazed or soldered to the end faces 62 to seal the slots. Coolant pipes 90 are received in the counterbores of each vertical passage 84 and brazed or soldered therein. Similar coolant connections, not shown, are provided at the outer extremities of the power leads 42 and 44. When the coolant pipes are connected with the supply and drain lines of the coolant supply, the direction of coolant flow through the coolant passages will be in the direction indicated by arrows. In the illustrated preferred embodiment, three separate coolant circuits are provided. A first coolant circuit extends through the passage 74 and slot 82. A second coolant circuit extends through the passage in conductor section 34*a*, the passage in power lead 42 and the slot 83 in the crossover conductor 36. A third cooling circuit extends through the passage in conductor section 34*b*, the passage in the associated power lead 44 and the slot 83 in the crossover conductor 38. The objective of the cooling branches is to provide high pressure, high flow rate cooling circuit throughout the operative length of the parallel conductors having sufficient heat removal capacity to keep the associated conductor at a controlled operating temperature. Should redundant circuits be desirable or required, it is apparent that parallel circuits can be provided within each of the cooling branches. Further, should only a single cooling circuit be desired, it is apparent that the inlet and the outlets can be in the power leads and a single hemispherical milled slot could be provided in the end faces 62 of the crossover conductors to interconnect the passages and the associated parallel conductors.

The flux concentrators 46 carried by the parallel conductors 32 and 34 provide, in a well known manner, control over the applied flux density in order to permit a single inductor to be used for heating, to a predetermined depth, workpieces having varying heat treated lengths or diameters. They are also effective for providing uniformity of the flux density on workpieces having axially cylindrical sections.

In order to be fully effective, it is necessary to locate the flux concentrator elements along the axial or longitudinal length of the parallel conductors in a position accurately corresponding to the desirred heating pattern. Moreover, at the incremental axial positions, it is necessary to have appropriately located elements for achieving the desired heating depth thereat on parts having profile variations.

As shown in FIGS. 4–8, the flux concentrator 46 are comprised of a plurality of U-shaped elements 100. The individual elements, in a well known manner, may be soft iron laminations or other high magnetic permeability laminates. Each element is formed with a pair of spaced legs 102, 104 which are slidably received over the top and bottom surfaces 52 and 54 of the associated parallel conductor sections. The effective length of the legs 102, 104 may be varied with respect to the parallel conductor to selectively vary the applied flux density therefrom. The flux concentrator elements are held in discrete banks of laminations by generally U-shaped keepers 110. The keepers 110 preferably formed of a high conductivity material such as copper have a peripheral profile corresponding to the shape of the flux concentrator elements. The width of the legs 112, 114 of the keeper members is slightly greater than the opening between the legs of the associated concentrator elements. Keyways 116 are formed transversly across the top and bottom surfaces of the parallel conductor sections and slidably receive the legs of the keepers in assembly. The keyways 116 are accurately referenced to the machined surfaces of the inductor so as to define between facing surfaces of the individual keepers or with an end face of a crossover conductor, an accurately axially located spacing for receiving a predetermined number of flux concentrator elements. In this manner, each lamination bank can be precisely controlled in length and accurately located on the conductor thereby giving greater uniformity in the heating pattern from inductor to inductor. To provide for greater versatility in a single inductor design, various keyways may be formed along the length of inductor sections. Such keyways can be selectively used for mounting lamination banks of varying lengths and configurations thereby enabling a single inductor design to inductively heat workpieces of varying configurations. While the keeper arrangement is obviously beneficially incorporated in the fully machined inductor coil described above, it is apparent that the accurate locating of the flux concentrator lamination banks can be achieved by providing comparable keeper arrangements on fabricated conductors. As shown in FIGS. 6 through 8, the keepers 110*a*, 110*b* and 110*c* and the concentrator elements 100 may have legs of differing lengths and shapes for providing discrete changes in the heating pattern for differing part profiles and hardness requirements while maintaining the overall inductor configuration. Further, the keeper arrangement is beneficial on inductor designs other than the single loop configuration wherein accurate positioning of the flux concentrator relative to the part is desirable.

I claim:

1. An inductor for inductively heating a cylindrical workpiece fixedly mounted for rotation about an axis and having an exterior cylindrical surface to be heated over a predetermined axial length comprising: a conductor member fixedly mounted with respect to the workpiece connectable to a power supply and having an axial conductor section in radially spaced relation to the workpiece surface and said axis said conductor section having a length greater than the predetermined axial length to be heated; slot means formed in the conductor section transverse to said axis, the axial distance between said slot means and the location thereof on said conductor section being accurately referenced to said predetermined axial length of the workpiece surface in said heating position; keeper means carried in the slot means having mutually facing axial faces defining said predetermined length; and, flux concentrator means carried on the conductor section, said flux concentrator means having an axial length equal to said predetermined length for establishing a uniform heating pattern over the predetermined length of the workpiece surface when the conductor member is energized by the power supply.

2. The inductor recited in claim 1 wherein said slot means comprise pairs of keyways formed transversely in opposed surfaces of said conductor section and said keeper means having spaced legs slidably retained in a pair of said slots.

3. The inductor recited in claim 2 wherein said flux concentrator means comprises a plurality of elements each having spaced legs slidably received over said opposed surfaces of said conductor section with said plurality of elements being retained between said facing surfaces of said keeper means.

4. The inductor recited in claim 3 wherein said concentrator means and said keeper means have substantially identical peripheral configurations.

5. In a single turn inductor comprising a pair of parallel conductors having a generally square cross section interconnected at the ends thereof by arcuate crossover conductors and having generally U-shaped flux concentrating members having spaced legs carried by the parallel conductors for establishing a flux concentration effect on a workpiece fixedly mounted for rotation about an axis and electrically inductively loaded therebetween wherein said flux concentrating members have predetermined widths and said workpiece has a predetermined length over which the flux concentration effect is to be imposed, the improvement comprising: at least two pairs of transverse slots formed in opposed surfaces of the parallel conductors and keeper members having spaced legs slidably received in pairs of the opposed slots, said slots being accurately spaced such that opposed mutually facing surfaces of the keeper members define the predetermined length whereby an even number of flux concentrators can be mounted therebetween to establish said predetermined length based on an even multiple of the predetermined widths of the flux concentrator members, said slots being located on the parallel conductor so to establish the flux concentration effect over said predetermined length of said workpiece and thereby accurately inductively heat the workpiece upon energization of the inductor.

6. The single turn inductor recited in claim 5 wherein said flux concentrator members are retained between adjacent keeper members.

7. The single turn inductor recited in claim 5 wherein flux concentrator members are retained between a flux concentrator member and one of said crossover conductors.

8. An inductor for establishing a flux concentration effect with respect to a cylindrical surface of predetermined axial length on a workpiece rotating about an axis comprising:

a conductor having ends adapted to be connected to a power supply and a conductor section radially spaced from the workpiece surface and axially overlying said cylindrical surface, said conductor being rectangular and having spaced top and bottom surfaces, and radially spaced inner and outer surfaces;

a flux concentrator comprising a plurality of generally U-shaped laminates having axial end faces axially spaced equal to said predetermined length and spaced legs slidable with respect to said top and bottom surfaces of said conductor with a base engaging said outer surface of said conductor;

first and second generally U-shaped keepers, said first keeper engaging one end face of said concentrator and said second keeper engaging the other end face of said concentrator, said keepers having leg portions of predetermined width; and, first and second sets of keyways transversely formed in top and bottom surfaces of the conductor complementary to the width and spacing of said keeper legs for slidably receiving the legs thereof, said first set of keyways being axially aligned with one end of said predetermined workpiece length, said second set of keyways axially aligned with the other end of said predetermined workpiece length, the spacing between mutually facing surfaces of said keepers being equal to said length of said concentrator, said concentrator being slidably received over said conductor section and retained between said keepers whereby energization of the power supply will provide said flux concentration effect over said predetermined length of said rotating workpiece.

* * * * *